US005937441A

United States Patent [19]

Raines

[11] Patent Number: 5,937,441

[45] Date of Patent: Aug. 17, 1999

[54] WEIGHTED EXERCISE AND THERAPEUTIC SUIT

[76] Inventor: Mark T. Raines, 304 Fawn Field Dr., Cedar Park, Tex. 78613

[21] Appl. No.: 08/692,428

[22] Filed: Aug. 5, 1996

Related U.S. Application Data

[63] Continuation-in-part of application No. 08/281,490, Jul. 27, 1994, abandoned.

[51] Int. Cl.[6] ..... A41D 13/00

[52] U.S. Cl. ..... 2/69; 2/227; 2/79; 482/105; 482/120

[58] Field of Search ..... 2/69, 79, 94, 227, 2/228, 238, 102, 247, 125, 161.1, 160, 243.1; 482/105, 120

[56] References Cited

U.S. PATENT DOCUMENTS

| | | | |
|---|---|---|---|
| 3,759,510 | 9/1973 | Jackson, Jr. | 482/105 |
| 4,268,917 | 5/1981 | Massey | 2/102 |
| 4,303,239 | 12/1981 | Walsh, Jr. | 482/105 |
| 4,330,120 | 5/1982 | Netti | 482/105 |
| 4,344,620 | 8/1982 | Debski | 482/105 |
| 4,384,369 | 5/1983 | Prince | 2/79 |
| 4,394,012 | 7/1983 | Egbert et al. | 2/250 X |
| 4,407,497 | 10/1983 | Gracie | 2/67 X |
| 4,602,387 | 7/1986 | Zakrzewski | 2/102 |
| 4,658,442 | 4/1987 | Tomlinson et al. | 2/102 X |
| 4,684,123 | 8/1987 | Fabry | 2/161.1 X |
| 4,953,856 | 9/1990 | Fox, III | 2/69 X |
| 4,958,386 | 9/1990 | Louis-Jeune | 2/227 |
| 5,002,270 | 3/1991 | Shine | 2/102 X |
| 5,010,596 | 4/1991 | Brown et al. | 2/228 |
| 5,033,117 | 7/1991 | Fairweather | 2/69 |
| 5,038,779 | 8/1991 | Barry et al. | 2/102 X |
| 5,048,125 | 9/1991 | Libertini et al. | 2/79 |
| 5,144,694 | 9/1992 | Conrad Da oud et al. | 2/69 |
| 5,176,600 | 1/1993 | Wilkinson | 482/105 X |
| 5,659,898 | 8/1997 | Bell, Jr. | 2/69 |

*Primary Examiner*—Gloria M. Hale
*Attorney, Agent, or Firm*—Royston, Rayzor, Vickery, Novak & Druce, L.L.P.

[57] ABSTRACT

Weighted suit to be used in athletic training, physical therapy, muscle toning and weight reduction. The suit has a bottom and top that can be adjusted to accommodate the physical characteristics of the wearer, as well as the activity to be performed by the wearer while the suit is worn. The suit also has weighted gloves which may be attached to the sleeve portion of the top of the suit. The suit is constructed from spandex material that accommodates stretch in one direction and resists it in another direction approximately perpendicular to the first. Weight compartments are located about the suit into which weight units may be installed. Variable weight packets may be used to selectively apply different resistance experienced during the user's activity. The weights are located away from the user's joints, and protective components may be integrally included into the suit to cover vulnerable knee and elbow joints. The suit is reinforced with support strapping that is continuously sewn to the suit for supporting the weight packets against gravity and inertial forces during use. A support belt for the user's back may be optionally included as an integral component. The suit clings snugly to the user's physique and therefore may be worn beneath other clothing, such as a business suit.

19 Claims, 7 Drawing Sheets

WEIGHTED EXERCISE AND THERAPEUTIC SUIT

This application is a continuation in part of Ser. No. 08/281,490 filed Jul. 27, 1994, now abandoned.

FIELD OF THE INVENTION

This invention pertains to athletic and therapeutic wearing apparel, and more particularly to weighted suits for applying variable resistance during user activity.

BACKGROUND OF THE INVENTION

Persons training for athletics and undergoing physical therapy often include work-outs with weights to increase and speed their progress. To meet this need, wearing apparel has been developed that incorporates weights into various designs. By inclusion of the weights in the garment itself, the wearer enjoys further benefits from the added resistance.

An example is U.S. Pat. No. 5,144,694 entitled Exercise Apparel and Weight Packets issued to Conrad Daoud et al. Therein, a garment is disclosed that includes a vest, pants, spine strap, belt, wrist bands, ankle bands and weight packets. The weight packet includes plural rows and plural columns of weight members that are installed in pockets; the pockets position the weights about the wearer's body. The placement of the weight is solely maintained by the snugness of the garment's fit to the wearer's body.

Similarly, U.S. Pat. No. 5,010,596 entitled Conformable Weighted Conditioning Garment issued to Brown et al discloses a garment in the form of shorts that provide a plurality of pouches in thigh encasing leg sections. It is explained that the leg sections of the shorts are secured to the wearer's legs above the knee by adjustable belts located in hems at the lower extremities of the leg sections. The conforming nature of the garment and the way in which the weights are snugly gripped within the pockets ensures that the weights do not move relative to the wearer's skin, and do not bobble or shift as the wearer runs or engages in other physical activity.

U.S. Pat. No. 5,033,117 entitled Exercise Garment issued to Fairweather discloses belted shorts having pockets into which weights may be deposited. Straps are connected between the weighted pockets and the belt loops so that the load of the pockets is supported by a belt, and not the garment itself.

Each of the above referenced patents disclose weighted garments that increase the resistance experienced by the wearer. None of the patents, however, disclose the utilization of construction materials that support the weights by resisting stretch in one direction while accommodating it in a generally perpendicular direction thereto. Nor is a garment disclosed that provides additional support for the individual weights through the use of stretch resistant straps that are incorporated into the body of the suit. The straps distribute the load of the weight across the suit, as opposed to having the load concentrated at the weight's location. Still further, it is not known to provide rubber coatings at the surface of exercise suit components for resisting relative slippage between components of the garment and items attached thereto.

SUMMARY OF THE INVENTION

This invention finds application in three primary areas: athletic training, physical therapy, and weight reduction. It is anticipated, however, that any user will reap benefits if resistance training is desired. The weighted exercise and therapeutic suit described herein provides a garment, that, when worn by a person involved in either athletic training, physical therapy or weight reduction programs, enhances the benefits of the activity undertaken. The invention provides a snugly form-fitting suit that clings snugly to the wearer's body. It may be constructed with pockets or other receptacles into which weights are addable. An improvement over known suits is that through its unique construction sufficient support is provided to the applied weights to fix their placement relative to the wearer. This is accomplished by three primary means. The first is the use of material that resists stretch in one direction while facilitating stretch in another. The second is the integral inclusion of support straps into the suit's construction that join one or more weight compartments in which the weight packets are contained. By continuously connecting the strap to the suit along the entire length of the strap, the load of the weight packet is distributed through out the suit's area. The third is the utilization of a rubberized coating applied to at least portions of different components that are positioned into face-to-face engagement during use. The friction experienced between the two rubberized surfaces resists slippage of the weighted portions with respect of the suit and wearer.

It has also been found that the suit serves as protective gear for the wearer because of the plate-like nature of the weight packets. In one embodiment, the weight packets are made of spandex or other elastic material formed into pockets and into which plastic encased flat lead ingots may be inserted. When strategically located about the wearer, the lead weight packets buffer the user should he or she fall or strike other objects. For safe use, the weight packets are placed away from the user's moving joints where the greatest ranges of flexion and mobility are required. This complements the protective gear that may be worn at the user's knees and elbows.

The suit provides versatility by having numerous weight compartments or packets positioned at various locations about the suit. In this way the suit may be selectively loaded for spot application of weighted resistance, or the suit may be generally loaded so that balanced resistance is experienced across the wearer's body. In use, the wearer may exercise an individual area of the body separately, or in unison with other areas through strategic placement of weight packets at one or more anatomical locations. The degree of load may also be varied by using lesser and/or greater weights. As a result, the many compartments of the suit and the variable weights make this invention exceedingly versatile.

Furthermore, through the use of relatively thin weights having a thickness on the order of about one-quarter inch, there is no bulkiness experienced by the wearer and the suit may be easily worn under other clothing in total concealment. Additionally, bulging will be minimized by the constrictive action of the two layers of spandex or other material of the suit's construction. During use, the heat of the user's body, together with the moisture of perspiration when present, causes the spandex suit to mold to the user's physique. This means that persons may reap the benefits of the suit even when not in training situations. A person could wear the weighted suit under a business suit without detection and constantly experience increased resistance during their everyday activities.

Examples of athletic applications of the inventions would include racquetball players wanting to increase the strength of their serving arm. In that case, a player may optionally use the weighted glove and/or apply weight packets upon the serving arm. This same regime could be used by tennis players and bowlers to tone and add mass to the forearm muscles. For basketball and volleyball players who want to increase their jumping abilities by strengthening their leg muscles, greater amounts of weight may be added about the suit, especially on the legs. Because of the potential symmetrical location of weight compartments about the wearer, even large amounts of weight may be added in a balanced fashion to a player. Similar benefits may be received by runners and swimmers who moderately weight the suit to achieve gains in speed and endurance. Similarly, those involved in organized aerobics will increase the results of a work-out by using the suit without using barbells or other external resistance aids. Most athletes will benefit from the suit because it does not interfere with the player's activity, but only adds beneficial resistance during practice and play alike; therefore, they can continue without interruption and with greater results.

Persons undergoing physical therapy will also benefit from use of the suit. The suit can be used to exercise injured muscles while in the hospital as part of a daily activity plan by adding the prescribed amount of weight to the specific muscle, or group of muscles, in need of strengthening. When required hospital care is completed, the patient may use the suit in the manner prescribed, plus begin to exercise the muscles that were not injured, but atrophied due to inactivity during the time of convalescence. Because the suit goes where the patient goes, it will not be required that he or she frequently return to a facility for therapy. This will further reduce recovery time by making it easier for that person to follow the prescribed treatment plan. Still further, a key to a patient's rapid recovery is often the consistent, but gradual increase in applied resistance. This suit provides an easily implemented means for delivering just such a gradual increase. By slowly increasing the weights applied about the patient, a slow but constantly more rigorous therapy may be administered.

The suit also produces beneficial results for overweight users. Because of the reduced physical capabilities of many overweight persons, it is important that their activity be increased, but not so strenuously that they risk over-exertion that could lead to serious consequences. This suit provides an excellent means by which they can gradually, but consistently increase the effects of prescribed activities. By having the added weight of the suit upon them, a person will burn additional calories as a result of any movement. Furthermore, they will simultaneously become more fit with greater muscle tone and strength.

In one embodiment, a weighted suit to be worn by a user is provided that has at least one suit body member constructed from stretchable material that is form fitting to the wearer's physique. There is at least one weight packet attachable to the suit body member and to be maintained at a relatively fixed location upon the user's physique. The stretchable construction of the material allows stretch in a first direction and resists stretch in a second direction that is substantially perpendicular to the first direction.

In one embodiment, the stretchable material from which the suit body member is constructed is breathable spandex that allows perspiration of the user to pass therethrough thereby providing comfort. The weight packets are spandex pouches with insertable plastic encased lead ingots with a thickness less than one-quarter inch. An adjustable securing band is integrally constructed into select weight compartments that are positioned upon the appendage segment for constriction about those select weight compartments.

In another embodiment, the weighted suit includes a suit body member that has a top suit body member constructed from stretchable material that is form fitting to a user's physique and a bottom suit body member also constructed from stretchable material that is form fitting to a user's physique and which is connectable to the top suit body member. There is at least one weight packet attachable to the suit body member for relatively fixed location upon the user's physique. The stretchable construction material of the suit body member allows stretch in a first direction and resists stretch in a second direction. Like the previous embodiment, the second direction is substantially perpendicular to the first direction. Still further, the first direction is substantially horizontal with respect to an erect user that has his or her arms to their side and the second direction is substantially vertical with respect to that same user.

Further, there is at least one weight compartment constructed integrally with the suit body member for receiving the weight packet. The weight packet is confined within the weight compartment so that the weight packet fits snugly to the user's physique and minimally extends therefrom and the support strap is constructed integrally with the weight compartment. An adjustable back support belt may be integrally constructed with the body suit body member for providing support to the user's back during strenuous activity. An outer shell covering portions of the suit and the weight unit may be included for surely fixing the weight packet's position upon the user. Several weight compartments may be positioned upon the suit so that several weight packets may be selectively distributed about the user. The stretchable material from which the suit body member is constructed is breathable spandex that allows perspiration of the user to pass therethrough thereby providing comfort to the user. The weight packets are spandex pouches with insertable plastic encased lead ingots with a thickness less than one-quarter inch. And there is an adjustable securing band integrally constructed into select weight compartments that are positioned upon the appendage segment for constriction about those select weight compartments.

With each embodiment, a weighted glove that may be connectable to a sleeve portion of the suit may be included. The glove may have variable configurations in which all or portions of each of the wearer's fingers are encased within the glove. It is contemplated that the ends of the glove fingers may be cut off so that the wearer's fingers extend beyond the glove's fingers, in a fashion similar to weight lifting gloves. The gloves are constructed predominantly from a spandex type material which may constitute multiple layers. There is genuine or synthetic leather covering the exterior of the palms and bottom of the fingers. There may also be a layer of soft, spongy, breathable and absorbent material placed between the layers of spandex at the top exterior surface of the glove. There are pockets constructed integrally with the glove's body for receiving applicable weights. The pockets have a double flap closure like the other weight packets of the suit. Furthermore, adjustable Velcro brand straps may be included which provide lift tabs for easy adjustment of the fit of the gloves and fastening and unfastening.

An alternative and preferred embodiment of the present invention includes a full body suit that may have several component parts. Primarily, those components are anticipated to be a top portion to cover the upper body of the wearer and a bottom or pant portion to cover the lower body of the wearer. Unlike the previously described embodiment, this body suit does not include compartments or pockets for the installation of weights therein. Instead, support straps are longitudinally included along lengths of different portions of the suit for coupling weight packets exteriorly thereto. It is contemplated that individual weight packets will be constructed of variable length that are intended to be wrapped around portions of the wearers body and connected upon itself thereby forming weighted belting portions about the wearer. These weighted belts are constructed at least partially from elastic that permits longitudinal stretch to accommodate either different appendages such as arms or legs or different sized people. By the boning support included in common elastic, unidirectional stretch is accommodated while stretch in a perpendicular direction is resisted. In this way the packets are constructed similarly to other portions of the suit which are configured to resist stretch in a generally vertical direction while accommodating stretch in a generally horizontal direction.

This preferred embodiment further includes the application of a rubberized coating to at least portions of the body suit. This same rubberized coating is applied to an interior surface of the weight packets and intended to be oriented in face-to-face engagement with one another when worn by a user. These rubberized surfaces provide substantial resistance to movement between the engaged surfaces because of friction developed therebetween. This fixes the two surfaces with respect to one another. In this way the weight packets are more surely fixed with respect to the wearer's body and prevented from sliding about during use. This has been found to be a substantial benefit over other known designs because of the ease in application of the rubberization to the various parts of the invention and the effective slip resistance that is achieved. This is attributable to the fact that the rubberization may be easily applied in a silk-screen manner to any portion of the several components of the invention.

DETAILED DESCRIPTION OF THE INVENTION

Figure 1:
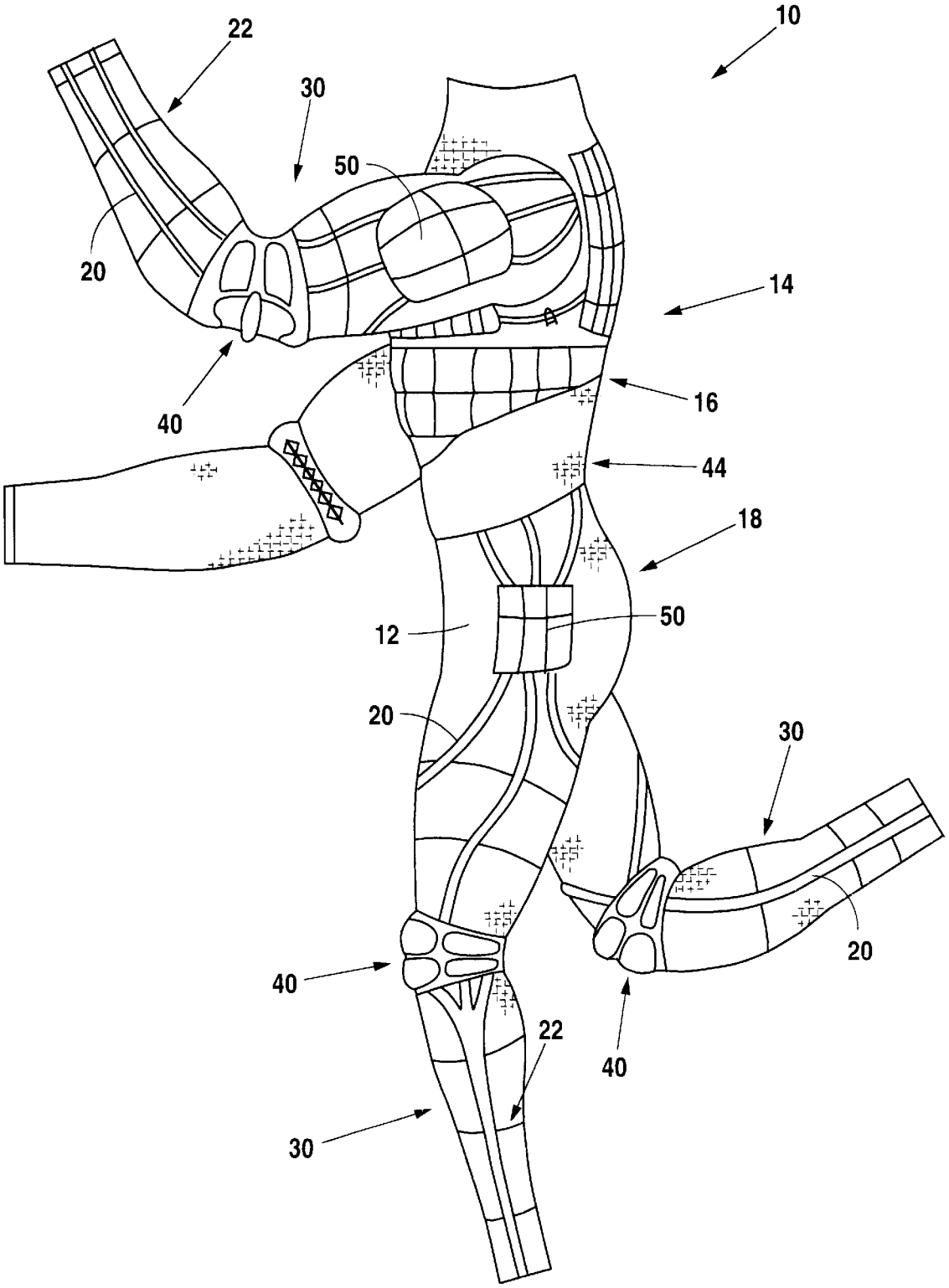
FIG. 1 is a perspective view of one embodiment of the weighted exercise and therapeutic suit.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Certain terminology will be used in the following description for convenience and reference only and not for purposes of limitation. For example, the words "rightwardly", "leftwardly", "upwardly" and "downwardly" will refer to directions in the drawings to which reference is made. The words "inwardly" and "outwardly" refer to directions toward and away from, respectively, the geometric center of the structure being referred to. This terminology includes these words, specifically mentioned derivatives thereof, and words of similar import.

Furthermore, elements may be recited as being "coupled"; this terminology's use anticipates elements being connected together in such a way that there may be other components interstitially located between the specified elements, and that the elements may be connected in fixed or movable relation one to the other. Certain components may be described as being adjacent to one another. In these instances, it is expected that such a relationship so described shall be interpreted to mean that the components are located proximate to one another, by not necessarily in contact with each other. Normally there will be an absence of other components positioned therebetween, but this is not a requirement. Still further, some structural relationships or orientations may be designated with the word "substantially". In those cases, it is meant that the relationship or orientation is as described, with allowances for variations that do not effect the cooperation of the so described component or components.

Referring to FIG. 1, a weighted suit 10 is shown upon a wearer's or user's body. The suit 10 comprises a suit body member 14 that includes a top suit body member 16 and a bottom suit body member 18. The suit body member 14 is primarily constructed from a stretchable material 12 that fits in a clinging fashion to the wearer's body. In a known embodiment, this material 12 would be referred to as spandex. The stretchable material 12 is constructed so that stretch is accommodated in a first direction and resisted in a second direction which is approximately perpendicular to the first direction. During construction of the suit 10, the stretchable material is oriented so that the first direction in which stretch is accommodated is oriented circumferentially about the wearer's body or limbs. That is to say, in portions of the suit 10 that fit about the wearer's torso, stretch would be accommodated around the persons body but resisted along the length of the body. Regarding portions of the suit 10 that cover the limbs of the wearer, stretch will be accommodated circumferentially about the arms or legs. Conversely, stretch will be resisted along the length of the arms and legs by the construction material 12.

With respect to the suit 10, the portions covering the arms and legs of the wearer are generally referred to as appendage segments 30. Each appendage segment 30 has a longitudinal length that is measured along the length of the limb and a tubular cross-section measured perpendicularly to the longitudinal length.

Pieces of protective gear 40 may also be seen being worn about the wearer's elbows and knees in FIG. 1. The protective gear 40 is commercially available and commonly used during sporting activities in which it is important to protect the knee and elbow joints.

A back support belt 44 which is used to support the wearer's back muscles during activities that put undue strain thereon is also shown in FIG. 1. Like the protective gear 40, back support belts 44 are commercially available and commonly known among athletes, and particularly among weight lifters.

Weight compartments 50 may be seen throughout the Figures as pocket type structures that are integrally constructed with the suit body member 14. In FIG. 1, weight compartments 50 maybe seen upon the arm and leg portions of the suit 10, as well as about the torso of the wearer.

Figure 2:
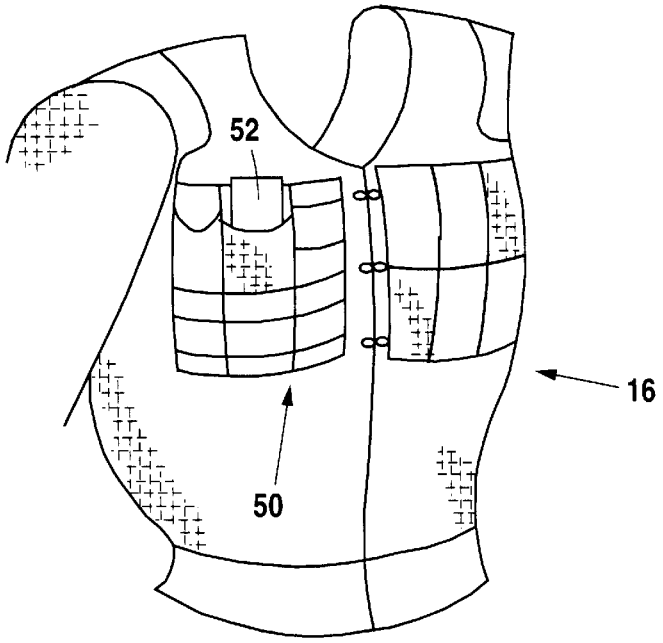
FIG. 2 is a front perspective view of the vested chest and back weight compartments with a weight packet being inserted in the cut-a-way portion at the left half of the suit.

Referring to FIG. 2, a weight packet 52 may be shown being installed into the weight compartment or pocket 50 upon the wearer's chest. It is contemplated that the weight compartments 50 may have added support in the form of straps that reinforce the compartment itself. Similarly, support straps 20 are included throughout the suit and which are continuously sewn along their lengths to the suit. The support straps 20 are used to distribute the load of the weighted compartments 50 across a greater area of the suit 10 than that of the compartment 50. A support of this nature may be seen in FIG. 2 upon the left hand side of the top suit body 16.

Figure 6:
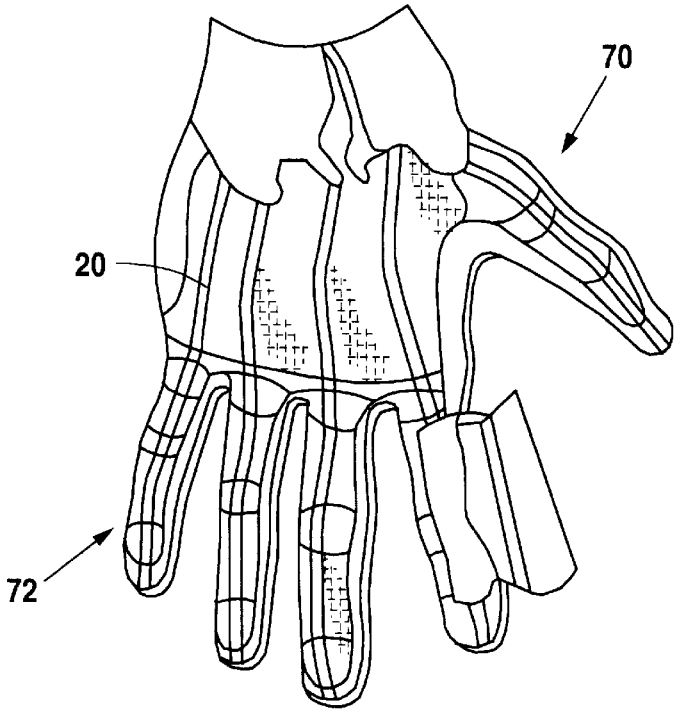
FIG. 6 is a perspective view of the weighted strap reinforced glove connectable to the sleeve of the top of the suit.

For the weight compartments 50 located upon the arms and legs of the wearer, adjustable securing bands 22 are also provided. The bands 22 are tightenable about the weight compartments 50 for restraining relative motion between the applied weight packets 52 and the wearer's body. The system of support straps may be most clearly seen in FIG. 1. Support straps 20, however, extend throughout the suit, including weighted glove 70 that is illustrated in FIG. 6.

The glove 70 fits about the wearer's hand and may include glove fingers 72 that either fully or partially encase the wearer's fingers. It is contemplated that like the suit body 14, the glove 70 will be constructed from stretchable material 12 and have weight compartments 50 constructed integrally therewith. When weighted, the inertial loads of the moving weights during the wearer's activity require the restraint of the support straps 20. The construction of the glove is contemplated to optionally be multi-layered. Two or more layers of spandex may be provided and between which there is an inner layer of spongy and stretchable material that is moisture permeable, and possibly absorbent. In this manner the hands may be padded and any perspiration occurring therein will be allowed to evaporate through the body of the glove 70. For durability, a leather type covering 70 may be provided upon the palm and underneath side of the wearer's fingers.

FIG. 2 illustrates a front side of the top suit body 16. It should be understood that weight compartments 50 may be carried on the front, or chest side of the suit, as well as the back side of the top suit body 16. It is contemplated that the top suit body 16 may be configured in any suitable orientation, including a vest style.

Figure 3:
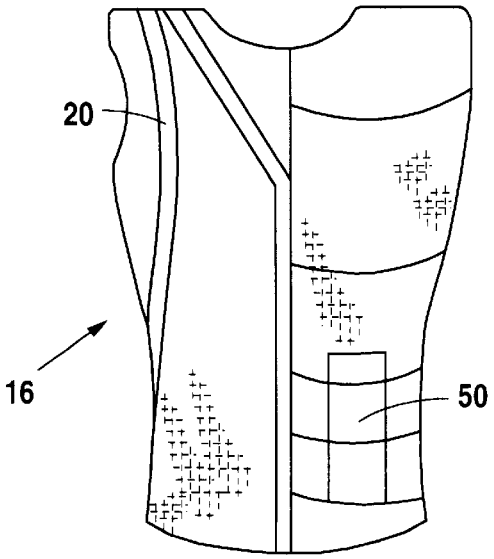
FIG. 3 is a front view of the top of the suit showing a weight compartment at the cut-away right hand side and the strap reinforced top at the left hand side.

FIG. 3 shows an alternative embodiment of the top suit body 16 in which the right side shows a cut-a-way view of a weight compartment 50 positioned upon the wearer's abdomen. Referring to the left side of the top suit body 16 of FIG. 3, an outer shell constructed from the stretchable material 12 may be seen with support straps 20 integrally sewn to the suit 10 for lateral support thereof. When connected with the weight compartment 50, the support straps 20 distribute the weighted load about the surface area of the suit 10 thereby preventing the load from being localized and helping to support the load in a stationary fashion upon the wearer's body.

Figure 4:
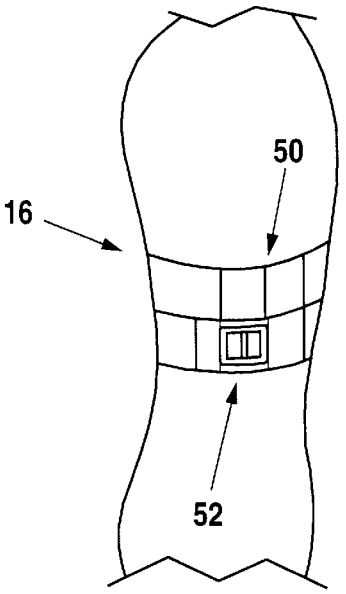
FIG. 4 is a side view of the top of the suit with a cut-away portion showing weight compartments and weight packets at the user's side.

FIG. 4 shows a partial cut-a-way from the side of the top suit body member 16 in which a weight packet 52 is exposed within a weight compartment 50 at the wearer's side.

Figure 5:
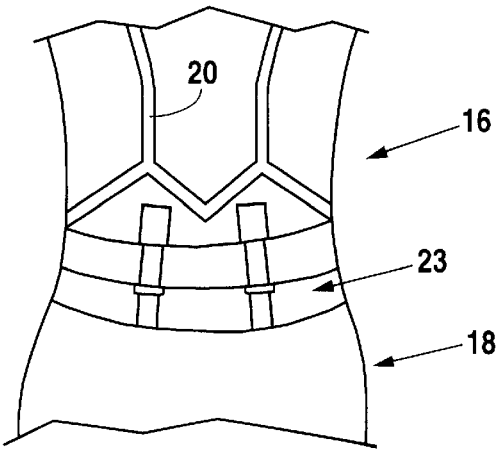
FIG. 5 is a back view of the top of the suit showing the strap reinforced panel.

FIG. 5 illustrates the back side of the top suit body member 16 showing support straps 20 continuously connected about the exterior of the top suit 16, as well as a connection means 23 between the top suit body 16 and bottom suit body 18.

Figure 7:
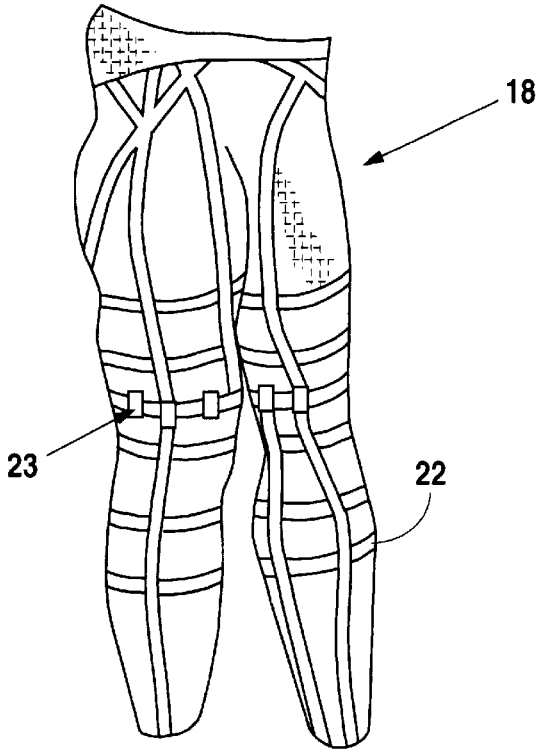
FIG. 7 is an alternative embodiment of the bottom of the suit showing weight compartments, support straps and a connection between the upper and lower portions of the suit's bottom.

Referring to FIG. 7, the bottom suit body member 18 may be seen in an alternative embodiment in which the pant comprises three separate parts. That is, there is an upper portion which fits about the lower body of the wearer and two other tubular segments that fit about the calf and knee area of the wearer. There is also a connections means 23 that releasably connects the upper portion with the calf covering tubular segments of the bottom suit body 18.

Weight compartments 50 may be located at various location about the suit body 14. Weight packets are not located about the wearer's joints thereby facilitating movement of those joints and preventing irritation and restriction to the wearer. As previously described, adjustable securing bands 22 that extend laterally about portions of the bottom suit body may be included in the suit's 10 design. The adjustable securing bands 22 provide additional support and restraint of movement for the weight compartments during a wearer's activity. With respect to construction and orientation of the stretchable material 12, stretch is facilitated about the wearer's legs and lower body but resisted along the length of the legs.

Once again referring to FIG. 2, an embodiment of a weight packet 52 is shown as it is being inserted into a weight compartment 50. In this case, the weight packet 52 is illustrated as being a spandex pouch with an insertable plastic encased flat lead ingot with a thickness less than one quarter inch.

Figure 8:
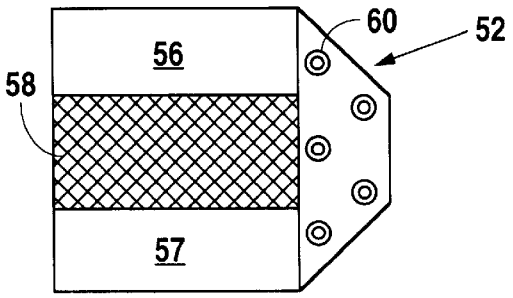
FIG. 8 is a front view of a weight packet showing an upper flap, lower flap and overlap area with attachment units.
Figure 9:
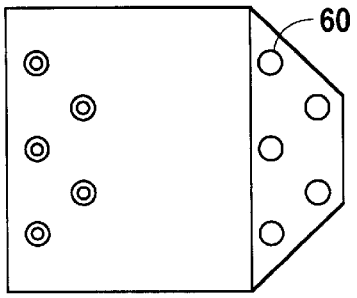
FIG. 9 is a back view of a weight packet with attachment units.

To facilitate variable and adjustable placement of the weight packets 52 about the weighted suit 10, it is contemplated that attachment units 60 and motion restrictor restraints 64 may be incorporated upon weight packets 52. For ease of construction, it is contemplated that the attachment units 60 and motion resistor restraints 64 may easily take the form of commercially available matable snap halves. Referring to FIG. 8, a double flap closure 54 configuration may be seen in which an upper flap 56 and lower flap 57 are constructed for cooperation with overlap area 58. In use, the weight unit 52 will be appropriately assembled and then fastened by the attachment unit 60 to the suit 10. It is contemplated that a piggy-back orientation similar to that shown in FIG. 11 may be accomplished in order to provide versatility with respect to the amount and location of weight added about the suit 10.

Figure 10:
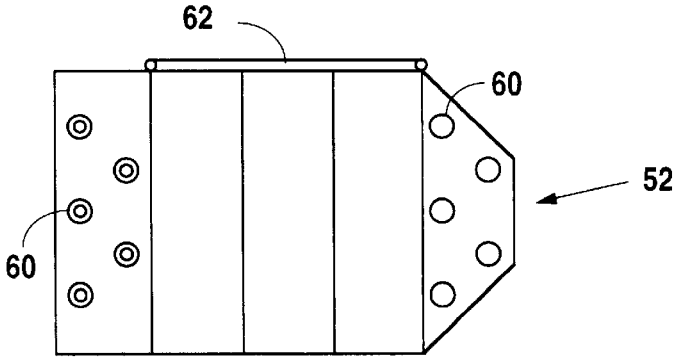
FIG. 10 is an elongated weight unit with attachment units and top units to resist dipping when between vertical restraints. It serves as a base unit length to which additional individual weight packets may be added.
Figure 11:
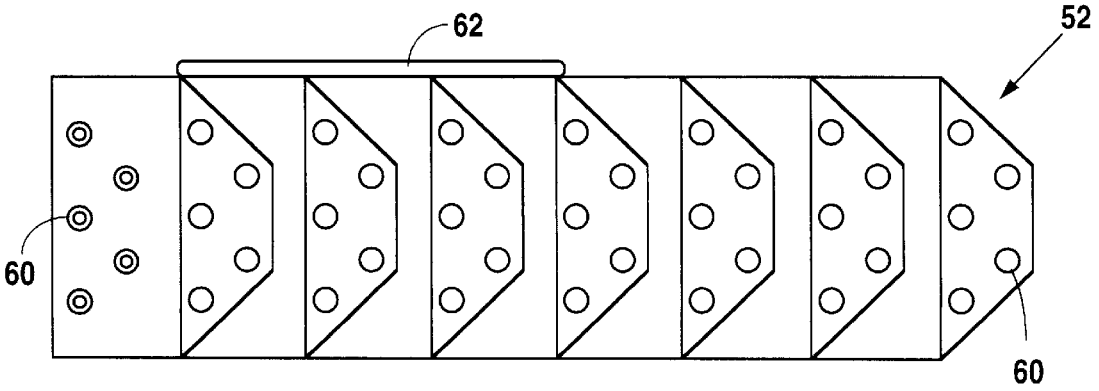
FIG. 11 is a series of weight packets connected together with attachment units and top units to resist dipping when between vertical restrictor restraints.

FIGS. 10 and 11 illustrate weight packets 52 that are rigidly supported by rigid units 62 along their lengths. In this manner dipping of the longer and piggy-backed packets 52 will be prevented since the lengths of the packet 52 will be effectively suspended by the rigid unit 62 between the two restrained ends of that packet 52.

Figure 12:
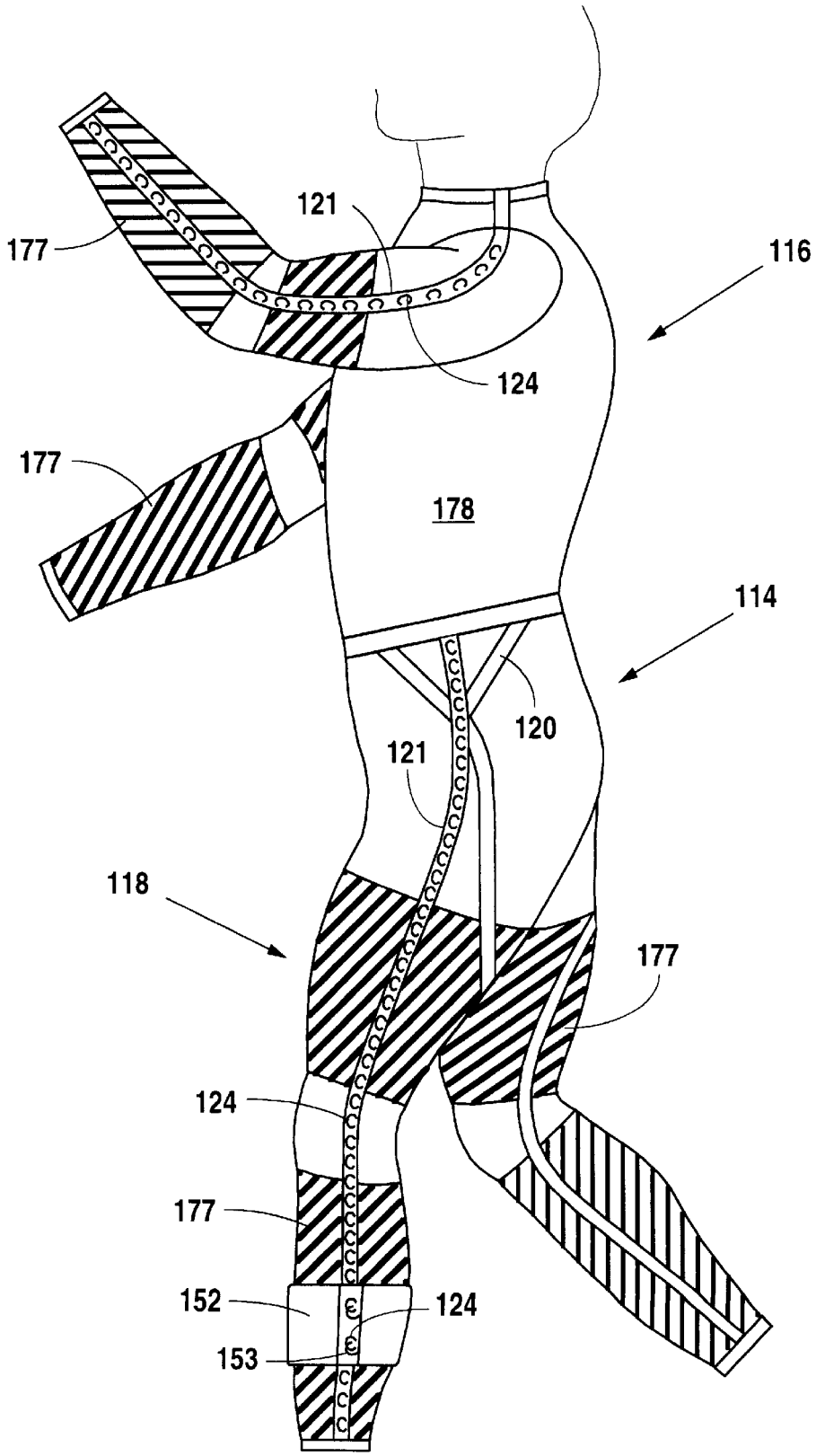
FIG. 12 is a side view of an alternative embodiment of the weighted exercise and therapeutic suit incorporating a rubberized coating on portions of the suit.
Figure 13:
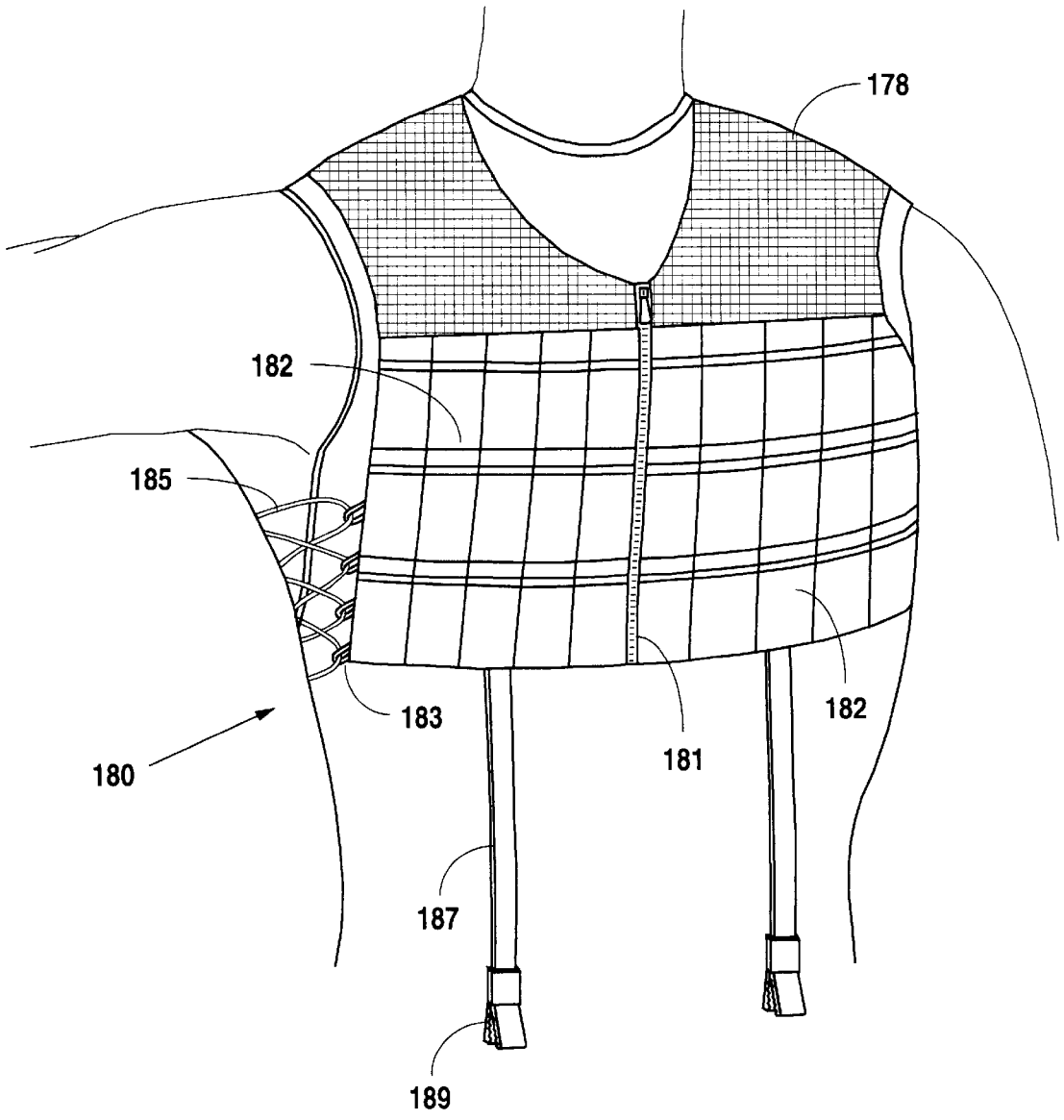
FIG. 13 is a perspective view of an optional weighted vest that may be used as an enhancement to the weighted exercise and therapeutic suit.
Figure 14A:
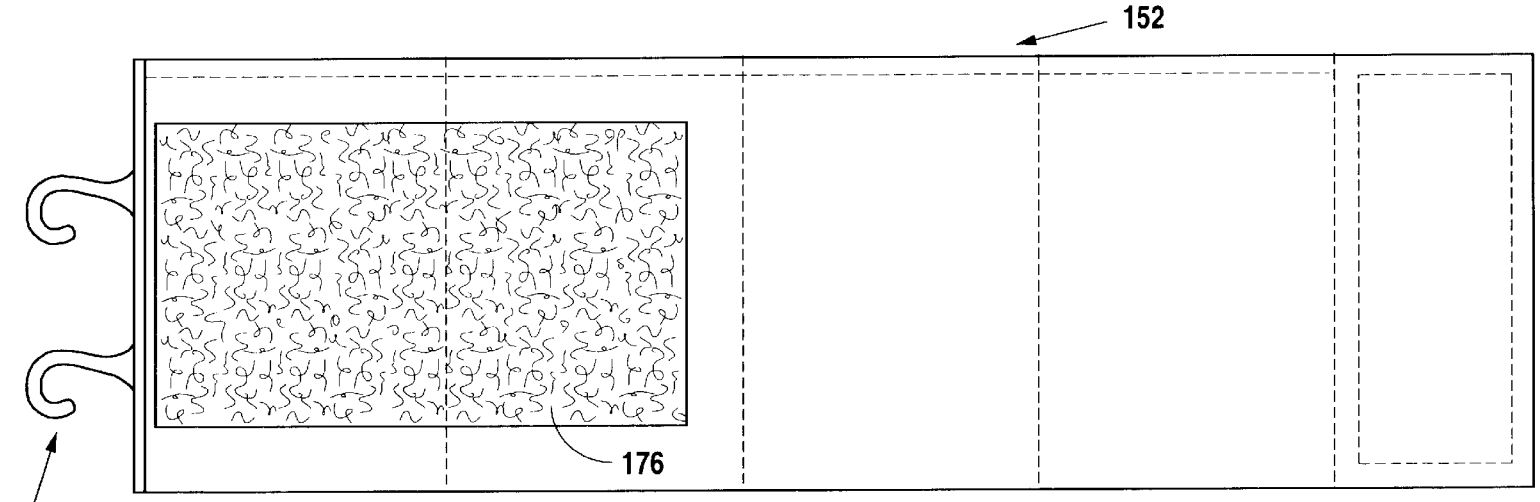
FIG. 14*a* is a front or exterior surface side view of a weight packet utilizable on the embodiment of the weighted exercise and therapeutic suit of FIG. 12.
Figure 14B:
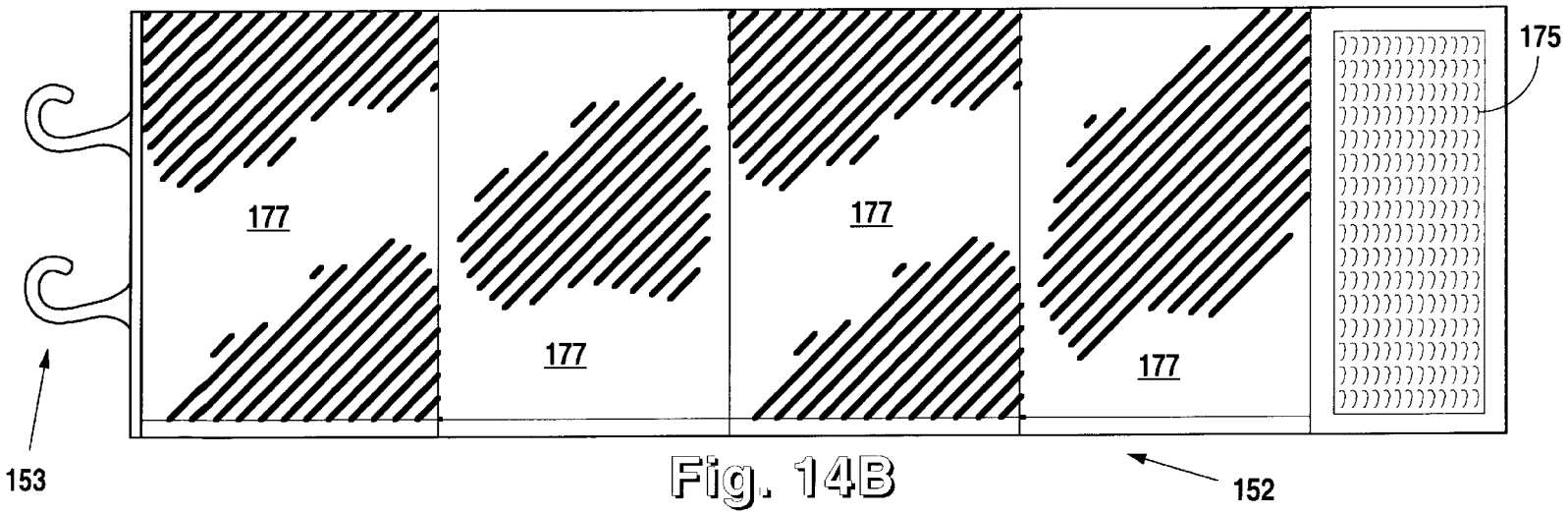
FIG. 14*b* is a back or interior surface side of the weight packet showing a partially rubber coated surface provided for face-to-face engagement with similarly rubberized portions of the suit of FIG. 12.

An alternative embodiment of the present invention is illustrated in FIGS. 12 through 14*b*. Therein, a full body suit 114 is shown upon a wearer. It is contemplated that the body suit 114 may be of a unitized construction creating a jumpsuit-type piece of clothing. Alternatively, the suit may be optionally divided into component pieces to facilitate the wearer putting on the suit 114. It is contemplated that at least a top suit member 116 is constructed for being worn about a person's upper body and a bottom suit member 118 is provided to be worn about the lower body. By having the body suit 114 divided into top and bottom components, putting on and taking off the suit is made easy. Like the other embodiment of the present invention, support straps 120 are provided along longitudinal or lengthwise portions of the suit 114. These support straps 120 are substantially non-stretchable and therefore provide longitudinal and usually vertical support to forces or weights applied thereto. Some of the support straps 120 include loops 124 at their exterior surfaces providing receivers for hooks 13 connected to weight packets 152. Unlike the previously described embodiment, the body suit 114 does not directly carry weight compartment pockets 60 thereon. Instead, the weight packets 152 of FIG. 14*a* and FIG. 14*b* are coupled directly to the suit members 116,118 at the loops 124 of the looped support straps 121.

It is contemplated that the weight packets 152 may be constructed of variable lengths by having several different individual, flap-closed compartments into which weights are to be deposited. The different lengths of packets 152 are required because they must completely span the circumference or perimeter of different portions of the wearer's body. As may be appreciated in FIG. 12, weighted packets or bands 152 will be belted around such portions of the wearer's body as the arms, torso, waist, hips and legs. In each instance the weight packets are include self adhering portions that make it possible for the elongate weight packets 152 to create enclosing belts wrappable around a body portion and connected back upon itself. In the embodiment of FIGS. 14*a* and 14*b*, VELCRO hook and loop fasteners are utilized. Specifically, hook fasteners 175 are connected to an interior surface of the packet 152 that is to be placed adjacent to, and in contact with the suit 114 is illustrated in FIG. 14B. Mating and engageable loop fastener 176 is provided on the exterior surface of the packet 152 that faces way from the suit 114 and wearer when installed thereupon. In this manner the weight packet 152 may be wrapped about a portion of the wearer's body and snugly secured thereabout using the hook and loop fastening mechanism. As may be seen in the illustration of FIGS. 14*a* and 14*b*, multiple pocketed compartments are provided in the elongate body of the packet 152. The length of the packet 152 may be extended by adding additional pockets or by merely adding additional construction material that increases the packet's 152 length.

It is contemplated that at least one side of the packet 152 will be constructed from conventional elastic that is stretchable in the direction of the longitudinal length of the packet 152, but stretch-resistant in a lateral length perpendicular thereto. This is usually accomplished in conventionally designed elastic with a boning-type of ridged construction.

It has been discovered that the weight packets 152 can be fixed relative to the wearer's body more surely and efficiently by applying a rubberized coating 177 to various surfaces of the suit 114 and the interior surface of the weight packets 152. In this manner, when the weight packets 152 are wrapped about portion of the body suit 114 and the two mating surface have each had the rubberized coating 177 applied thereto, significant friction is experienced therebetween and effectively fixes the packet 152 with respect to the wearer's body. This fixation is enhanced by the ability to tighten the fit of the packet 152 about the wearer based upon the selected position of the connection between the hook 175 and loop 176 fasteners. Still further, the elasticity of the body of the weight packet 152 helps assure that a snug fit is maintained during use of the packet 152 upon the suit 114.

For more definite attachment of the weight packet 152 to the suit 114, hooks 153 are provided upon the packets 152 for insertion through the loops 124 of the support straps 121. In this way, the mass of the packets 152 are more surely vertically fixed on upright portions of the wearer. In a similar fashion, the weight packets 152 are fixed with respect to the wearer's arms by similar hook 153 and loop 124 means, together with contacting rubber coated 177 surfaces.

While spandex has been chosen as one material of construction for the body suit 114, a more recently developed material trade named COOL-MAX by DUPONT is also used. One feature of the COOL-MAX brand material is that it is uni-directionally stretchable for providing support to the weight packets connected thereto. The material is also breathable thereby providing cooling transpiration for the wearer.

The rubberized coating 177 is applied in manner so that an absolute seal is not provided about the body of the suit 114 wearer. Instead, the coating 177 is intermittently applied, even if with only minute interstitial spacings, thereby providing breathing capabilities of the fabric therethrough for transpiration of perspiration. A preferred method of applying the rubberized coating 177 to the construction material of the body suit 114 and the interior surfaces of the weight packets 152 is through a silk-screening process wherein a fluidized rubberizing substance is applied similarly to how paints are applied to other materials like T-shirts and the like.

Referring to FIG. 13, an optional vest 180 is illustrated that may be worn either with or without the other components of the suit 114. The upper portion of the vest 180 is constructed from the COOL-MAX brand material 178 that permits stretching in lateral or horizontal directions, but resists vertical stretching. The vest 180 comprises a collection of weight pockets 182 that are arranged generally about a lower portion of the vest 180. The specific configuration of the weight pockets 182 is unimportant. In the illustrated embodiment, however, the weight pockets 182 are similarly constructed to the weight compartments 50 of the previously described embodiment of the invention. A plurality of weight pockets 182 are provided, each of which may or may not have weight ingots inserted therein depending upon the desires of the wearer.

To facilitate use of the vest 180, a zipper 181 is provided at the front-center of the vest 180. To further assure that the vest 180 fits snuggly and is variably adjustable, loops 183 are provided at the sides of the vest 180 which receive a cinch string 185 that may be tightened or loosened to accommodate the particular wearer's body size and customize the vest's 180 fit. As previously described, the vest 180 illustrated in FIG. 13 may be worn under the top suit member 116 of the body suit 114 or by itself. In either configuration, anchor straps 187 are provided to anchor the weighted vest 180 against upward movement with respect to the wearer. Alligator-type clips 189 are provided at terminal lower ends of the anchor straps 187 for releasably fixing the straps 187 to an anchoring portion of the body suit 114 or other article of clothing of the wearer. An example would be clipping the anchor straps 187 to the waistband of a pair of shorts that are also being worn.

While the embodiment of FIGS. 12 through 14 is separately described from that embodiment of FIGS. 1 through 11, it should be understood that various features may be substituted therebetween, as well as other alternatives that perform similarly or can be readily substituted therefore.

An exercise and therapeutic suit and its components has been described herein. These and other variations, which will be appreciated by those skilled in the art are within the intended scope of this invention as claimed below. As previously stated, detailed embodiments of the present invention are disclosed herein; however, it is to be understood that the disclosed embodiments are merely exemplary of the invention that may be embodied in various forms.

What is claimed and desired to be secured by letters patent is as follows:

1. A weighted suit to be worn by a user, the weighted suit comprising:

at least one suit body member constructed from stretchable material that is form fitting to a user's physique;

at least one weight packet attachable to said suit body member for relatively fixed location upon the user's physique; and at least one support strap for distributing the weighted load about the surface area of the suit;

said stretchable construction material of said suit body member allowing stretch in a first direction and resisting stretch in a second direction.

2. The weighted suit to be worn by a user as recited in claim 1, wherein said second direction is substantially perpendicular to said first direction.

3. The weighted suit to be worn by a user as recited in claim 2, wherein said suit further comprises:

at least one appendage segment having a longitudinal length greater than a substantially tubular cross-section taken perpendicular to said longitudinal length;

said appendage segment being connectable to said suit body member;

at least one weight packet attachable to said appendage segment; and with respect to said appendage segment, said first direction is substantially perpendicular to the longitudinal length of said appendage and said second direction is substantially aligned with said longitudinal length.

4. The weighted suit to be worn by a user as recited in claim 2, wherein:

said first direction is substantially horizontal with respect to an erect user in an arms to the side position; and said second direction is substantially vertical with respect to an erect user in an arms to the side position.

5. The weighted suit to be worn by a user as recited in claim 4, wherein said suit further comprises:

at least one appendage segment having a longitudinal length greater than a substantially tubular cross-section taken perpendicular to said longitudinal length;

said appendage segment being connectable to said suit body member;

at least one weight packet attachable to said appendage segment; and with respect to said appendage segment, said first direction is substantially perpendicular to the longitudinal length of said appendage and said second direction is substantially aligned with said longitudinal length.

6. The weighted suit to be worn by a user as recited in claim 5, wherein said support strap is constructed integrally with said suit for supporting said weight packet in the second direction.

7. The weighted suit to be worn by a user as recited in claim 6, further comprising:

at least one weight compartment constructed integrally with said suit body member for receiving said weight packet;

said weight packet confined within said weight compartment so that said weight packet fits snugly to the user's physique and minimally extends therefrom; and said support strap is constructed integrally with said weight compartment.

8. The weighted suit to be worn by a user as recited in claim 7, further comprising:

an outer shell covering portions of said suit and said weight packet for surely fixing said weight packet's position upon the user; and a plurality of weight compartments positioned upon said suit so that a plurality of weight packets may be selectively distributed about the user.

9. The weighted suit to be worn by a user as recited in claim 8, further comprising:

said stretchable material from which said suit body member is constructed is breathable spandex that allows perspiration of the user to pass therethrough thereby providing comfort to the user;

said weight packets are spandex pouches with insertable plastic encased lead ingots with a thickness less than one-quarter inch; and an adjustable securing band integrally constructed into select weight compartments that are positioned upon said appendage segment for constriction about said select weight compartments.

10. A weighted suit to be worn by a user, the weighted suit comprising:

a suit body member comprising:

a top suit body member constructed from stretchable material that is form fitting to a user's physique;

a bottom suit body member constructed from stretchable material that is form fitting to a user's physique and connectable to said top suit body member;

at least one weight packet attachable to said suit body member for relatively fixed location upon the user's physique; and at least one support strap for distributing the weighted load about the surface area of the suit;

said stretchable construction material of said suit body member allowing stretch in a first direction and resisting stretch in a second direction.

11. The weighted suit to be worn by a user as recited in claim 10, wherein said second direction is substantially perpendicular to said first direction.

12. The weighted suit to be worn by a user as recited in claim 11, wherein:

said first direction is substantially horizontal with respect to an erect user in an arms to the side position; and said second direction is substantially vertical with respect to an erect user in an arms to the side position.

13. The weighted suit to be worn by a user as recited in claim 12, wherein said suit further comprises:

at least one appendage segment having a longitudinal length greater than a substantially tubular cross-section taken perpendicular to said longitudinal length;

said appendage segment being connectable to said suit body member;

at least one weight packet attachable to said appendage segment; and with respect to said appendage segment, said first direction is substantially perpendicular to the longitudinal length of said appendage and said second direction is substantially aligned with said longitudinal length.

14. The weighted suit to be worn by a user as recited in claim 13, wherein said support strap is constructed integrally with said suit for supporting said weight packet in the second direction.

15. The weighted suit to be worn by a user as recited in claim 14, further comprising:

at least one weight compartment constructed integrally with said suit body member for receiving said weight packet;

said weight packet confined within said weight compartment so that said weight packet fits snugly to the user's physique and minimally extends therefrom; and said support strap is constructed integrally with said weight compartment.

16. The weighted wearing apparel to be worn by a user as recited in claim 15, further comprising:

an adjustable back support belt integrally constructed with said body suit body member for providing support to the user's back during strenuous activity.

17. The weighted suit to be worn by a user as recited in claim 16, further comprising:

an outer shell covering portions of said suit and said weight unit for surely fixing said weight packet's position upon the user; and a plurality of weight compartments positioned upon said suit so that a plurality of weight packets may be selectively distributed about the user.

18. The weighted suit to be worn by a user as recited in claim 17, further comprising:

said stretchable material from which said suit body member is constructed is breathable spandex that allows perspiration of the user to pass therethrough thereby providing comfort to the user;

said weight packets are spandex pouches with insertable plastic encased lead ingots with a thickness less than one-quarter inch; and an adjustable securing band integrally constructed into select weight compartments that are positioned upon said appendage segment for constriction about said select weight compartments.

19. The weighted suit to be worn by a user as recited in claim 18, further comprising:

a weighted glove connectable to a sleeve portion of the suit.

* * * * *